US006301816B1

(12) United States Patent
Saltz

(10) Patent No.: US 6,301,816 B1
(45) Date of Patent: Oct. 16, 2001

(54) FIREARM TRIGGER LOCK

(75) Inventor: Mitchell A. Saltz, Scottsdale, AZ (US)

(73) Assignee: Saf-T-Hammer Inc, Scottsdale, AZ (US)

( * ) Notice: Subject to any disclaimer, the term of this patent is extended or adjusted under 35 U.S.C. 154(b) by 0 days.

(21) Appl. No.: 09/322,111

(22) Filed: May 27, 1999

(51) Int. Cl.[7] ..... F41A 17/22

(52) U.S. Cl. ..... 42/70.06; 42/70.06; 42/70.07; 42/70.01; 42/70.11

(58) Field of Search ..... 42/70.06, 70.01, 42/70.07, 70.11

(56) References Cited

U.S. PATENT DOCUMENTS

| | | | | |
|---|---|---|---|---|
| D. 196,842 | | 11/1963 | Schaefer | D30/1 |
| 2,503,953 | | 4/1950 | Lind | 42/70 |
| 2,505,227 | | 4/1950 | Charters | 42/70 |
| 2,945,316 | | 7/1960 | Mulno | 42/66 |
| 3,066,433 | | 12/1962 | Rogers et al. | 42/70 |
| 3,139,694 | | 7/1964 | Schaefer | 42/70 |
| 3,352,047 | | 11/1967 | McDonnell | 42/70 |
| 3,449,988 | * | 6/1969 | Gallo | 81/90 |
| 3,616,559 | | 11/1971 | Sobolewski | 42/1 |
| 3,673,725 | | 7/1972 | Cravener | 42/1 R |
| 4,628,626 | * | 12/1986 | Brandt | 42/70.01 |
| 4,825,576 | * | 5/1989 | Troncoso | 42/70.07 |
| 4,972,618 | * | 11/1990 | Justice, Sr. et al. | 42/70.11 |
| 5,012,605 | | 5/1991 | Nishioka | 17/2 |
| 5,042,185 | * | 8/1991 | Justice, Sr. | 42/70.11 |
| 5,125,178 | * | 6/1992 | Justice | 42/70.11 |
| 5,515,634 | * | 5/1996 | Kong | 42/70.11 |
| 5,927,578 | * | 7/1999 | Kay | 42/94 |
| 6,032,396 | * | 3/2000 | Shapiro | 42/70.06 |

FOREIGN PATENT DOCUMENTS

| | | | | |
|---|---|---|---|---|
| 657148 | * | 2/1938 | (DE) | 42/59 |

* cited by examiner

*Primary Examiner*—Michael J. Carone
*Assistant Examiner*—John Richardson
(74) *Attorney, Agent, or Firm*—The Halvorson Law Firm

(57) ABSTRACT

The present invention is a device that, when used properly, is useful for increasing the safety of firearms. In one embodiment, the present invention comprises a threaded aperture located in a rear position of a firearms' trigger, toward the handle. The preferred location of the aperture is located close to an upper rear corner of an exposed surface of the trigger. Inserted into the threaded aperture is a complementarily threaded barrel screw. The screw has a special keyed head. The special key configuration of the head prevents curious children from inadvertently reversing the safety mechanism. In a preferred embodiment, the keyed head has a pentagonal shaped indentation and generally centered within the indentation is an outwardly projecting guide pin. When the screw has been inserted into the aperture, there are two function positions. In a use position, the screw is contained in the trigger and does not substantially project from the trigger. In a safe position, the screw has been advanced from the use position, by use of the special key, and projects from the trigger a sufficient amount to block substantial movement of the trigger. The screw blocks the movement of the trigger by projecting to a position adjacent the firearm frame.

3 Claims, 3 Drawing Sheets

FIREARM TRIGGER LOCK

FIELD OF THE INVENTION

The present invention relates to the field of firearm safety devices. More specifically, the present invention relates to devices that help prevent accidental discharge of the firearm, such as a trigger lock.

BACKGROUND

Our society is experiencing an increase in criminal activity against individuals. This has spurred many individuals to keep firearms in their homes for personal protection. While a firearm, by itself, is not dangerous, when loaded there is a potential for accidental discharge. However, an unloaded weapon proves to be of little help when facing an attacker or intruder. Therefore, keeping home firearms loaded is the trend, despite the potential for accidents.

The increasing trend of keeping loaded firearms at home has probably resulted in an observed increase in the number of accidental weapon firings. These accidents are frequently caused by children playing with the weapon, or adults who are unaware of the loaded condition of the firearms. Thus, there is a need for devices that enhance the safety of loaded firearms and help reduce the frequency of accidental discharges. Moreover, current trends in legal liability are indicating an increased burden upon those who supply firearms to provide safer weapons.

The device of the present invention, which helps solve these and other problems, relates specifically to firearms with trigger and/or trigger guard. Typically, the trigger and trigger guard of the firearm are mounted beneath the barrel and firing mechanism Almost all firearms are provided with some form of safety mechanism which, when activated, is designed to prevent accidental or unwanted discharge of the firearm as it is carried or handled. These safety mechanisms may comprise a safety notch in the hammer that is engaged by the sear (or some equivalent element) of the trigger when the hammer is in its safe position (out of contact with the firing pin), or it may comprise a separate member that can be placed between the hammer and the frame to prevent the hammer from striking the firing pin. Also, there are a variety of separate attachable safety mechanisms, frequently covers for the trigger area that prevent access to the trigger by a finger.

While the above devices address some of the problems of firearm safety, it is evident that there is a present and a continuing need for further developments in the field of firearm safety devices.

SUMMARY OF THE INVENTION

It is an object of the present invention to provide a firearm safety device that prevent the accidental movement of a trigger or trigger assembly.

It is another object of the present invention to provide a firearm safety device that is integrally incorporated into a trigger of a firearm and prevents the accidental movement of the trigger.

It is a further object of the present invention to provide a firearm safety device that is integrally incorporated into a trigger guard and engages a trigger of a firearm and prevents the accidental movement of the trigger.

It is yet another object of the present invention to provide an integrally incorporated firearm safety device that utilizes a key headed barrel screw located in a rear portion of a trigger.

It is yet a further object of the present invention to provide an integrally incorporated firearm safety device that utilizes a key-headed barrel screw located in the trigger guard and that, when in a safe position engages a trigger of a firearm.

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Description of Preferred Embodiments is not intended to indicate a desire to invoke the special provision of 35 U.S.C. §112, paragraph 6 to define the invention. To the contrary, if the provisions of 35 U.S.C. §112, paragraph 6, are sought to be invoked to define the invention(s), the claims will specifically state the phrases "means for" or "step for" and a function, without also reciting in such phrases any structure, material, or act in support of the function. Even when the claims recite a "means for" or "step for" performing a function, if they also recite any structure, material or acts in support of that means of step, then the intention is not to invoke the provisions of 35 U.S.C. §112, paragraph 6. Moreover, even if the provisions of 35 U.S.C. §112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

DESCRIPTION OF PREFERRED EMBODIMENTS

Figure 1:
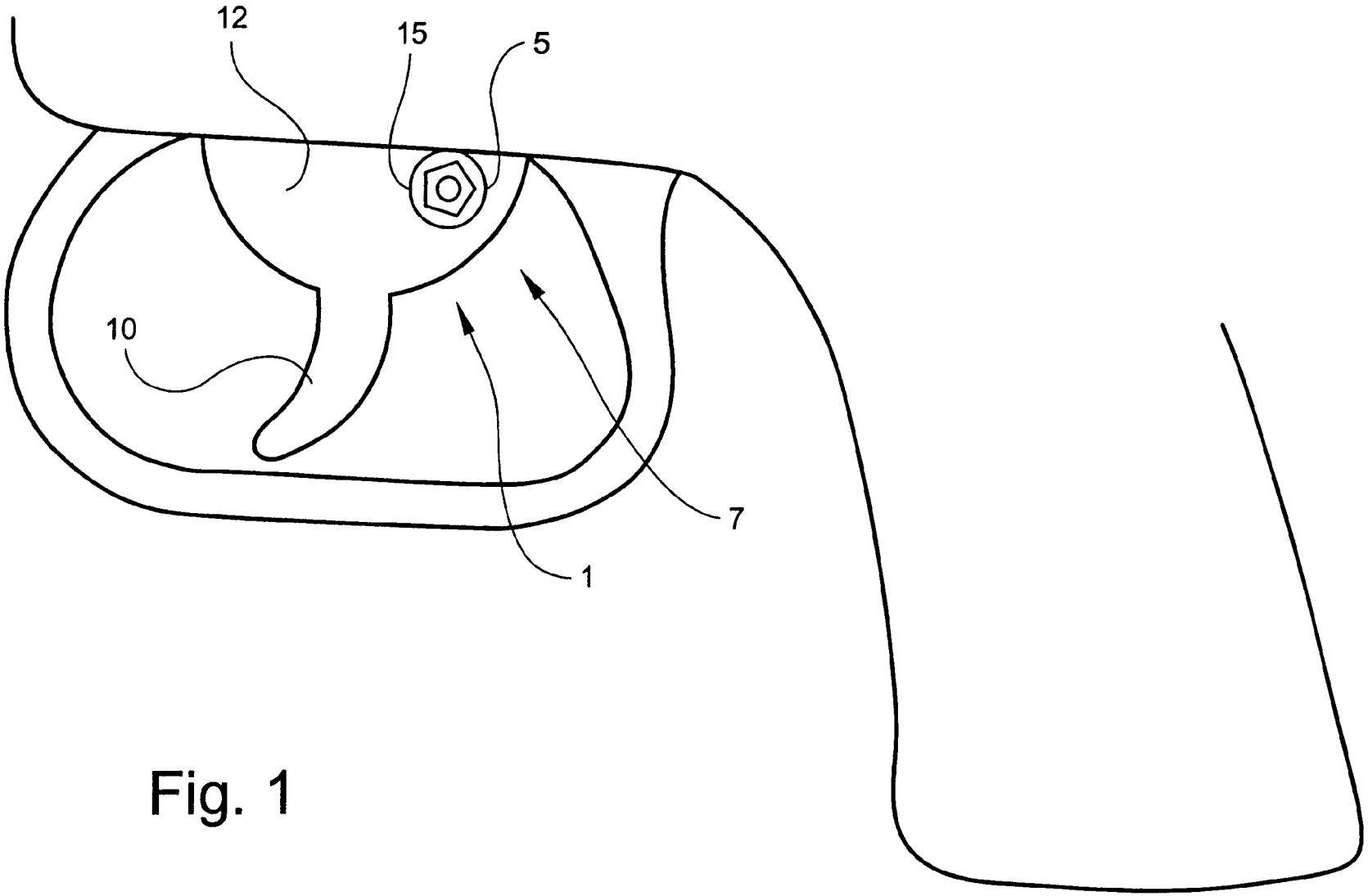
FIG. 1 is a side view illustrating the position of the screw and aperture according to a first embodiment of the present invention.
Figure 2:
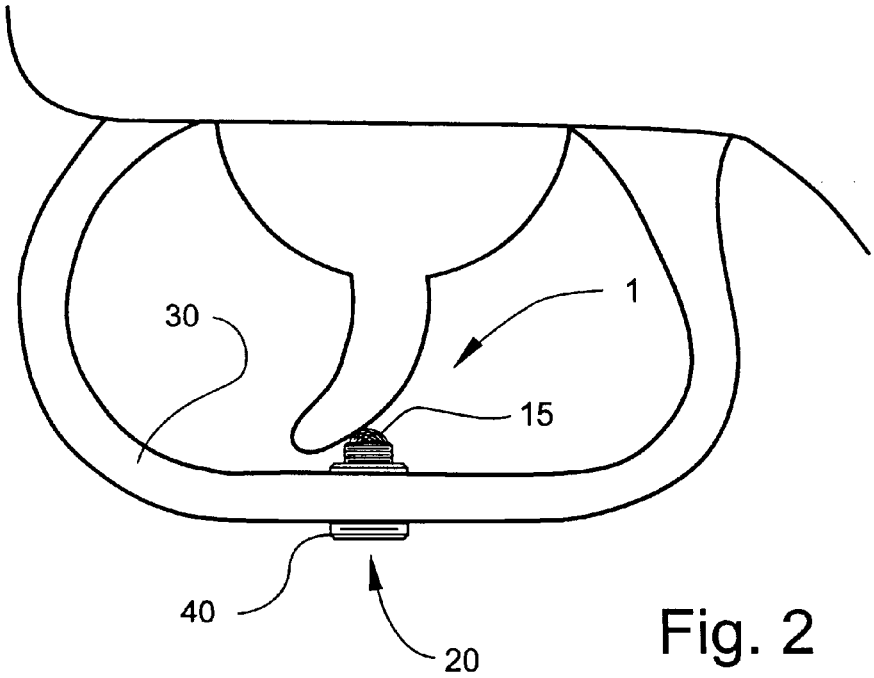
FIG. 2 is a side view illustrating the position of the screw and aperture according to a second embodiment of the present invention.
Figure 3:
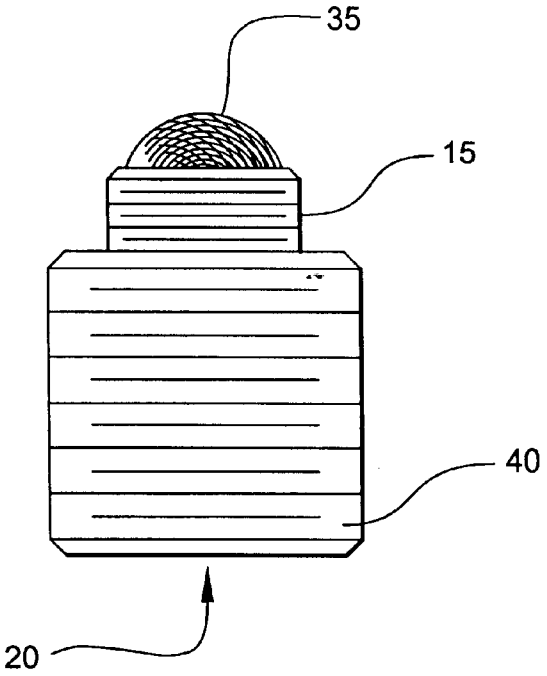
FIG. 3 is a side view of one embodiment of the threaded screw of the present invention, the lower port of the illustration of this embodiment is a threaded blank insert.
Figure 4:
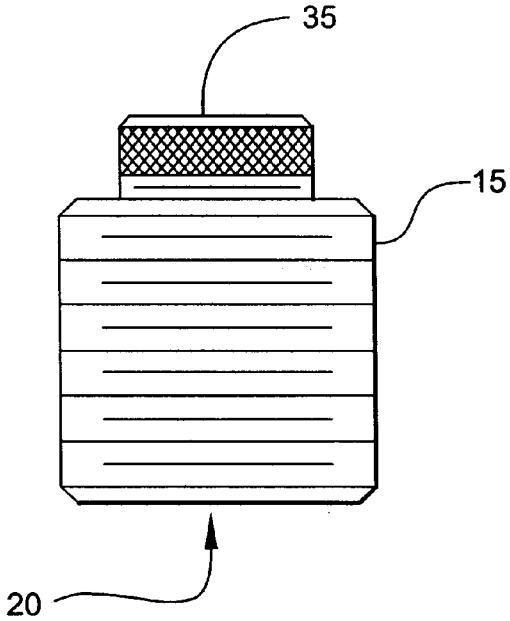
FIG. 4 is a side view of an alternate embodiment of the threaded screw of the present invention.
Figure 5:
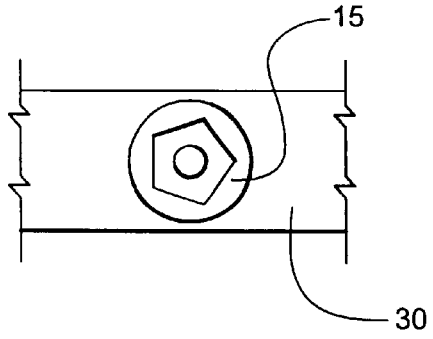
FIG. 5 is a view of the bottom of a trigger guard showing the screw contained within the insert located in the trigger guard.
Figure 6:
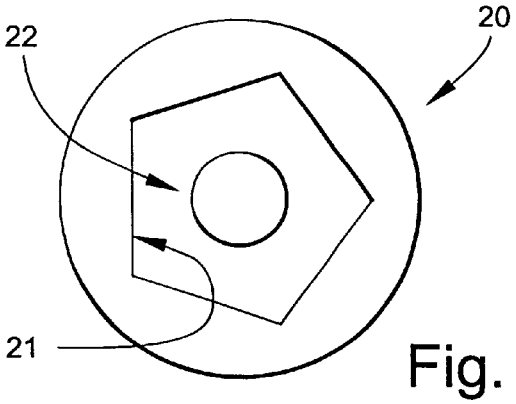
FIG. 6 is a view of an embodiment of the keyed head of the screw of the present invention.
Figure 7:
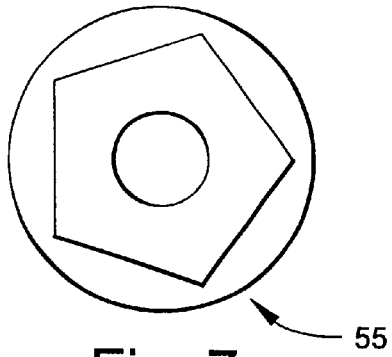
FIG. 7 is view of the end of a special key that fits the screw according to the present invention.
Figure 8:
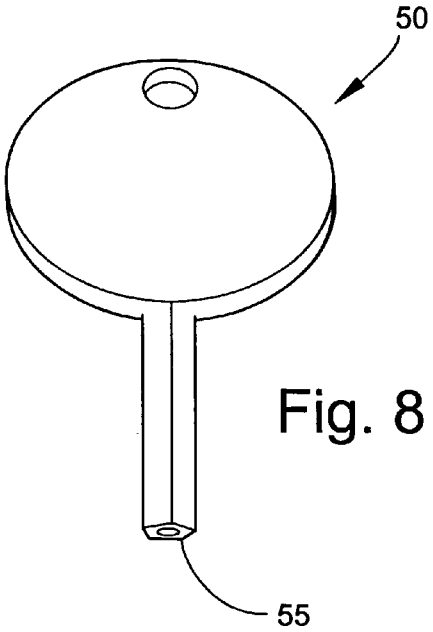
FIG. 8 is a side view of a regular key form for the special key of the present invention.
Figure 9:
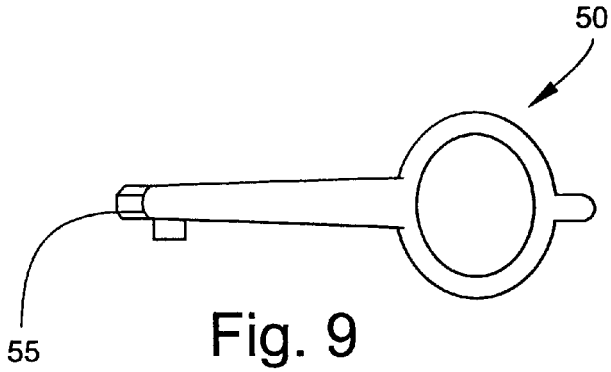
FIG. 9 is a side view of a handcuff style key form according to the present invention.

The present invention is a device that, when used properly, is useful for increasing the safety of firearms. The present invention is an improvement of a firearm and is integrally incorporated in a weapon.

In one embodiment, the present invention 1 comprises a threaded aperture 5 located in a rear position 7 of a firearms' trigger 10, toward the handle 11. The preferred location of the aperture 5 is located close to an upper rear comer of an exposed surface 12 of the trigger 10.

Inserted into the threaded aperture 5 is a complementarily threaded barrel screw 15. The barrel screw 15 is preferably no longer than the thickness of the trigger 10. The screw 15 has a special keyed head 20. The special key configuration of the head 20 prevents curious children from inadvertently reversing the safety mechanism. In a preferred embodiment, the keyed head 20 of the screw 15 has a pentagonal shaped indentation 21 and generally centered within the indentation is an outwardly projecting guide pin 22. The guide pin 22 serves at least two purposes. First, it guides a drive key 50 into proper position, and second, it prevents the use of a simple five-sided, or modified hex, driver from being inserted into the indentation. In order to advance or retreat the screw 15, the drive key 50, a special key, needs a complementarily matching head 55.

When the screw 15 has been inserted into the aperture 5, there are two useful positions. In a use position, the screw 15 is contained in the trigger 10 and does not substantially project from the trigger 10. In a safe position, the screw 15 has been advanced from the use position, by use of the special key 50, and projects from the trigger 10 a sufficient amount to block substantial movement of the trigger 10. The screw 15 blocks the movement of the trigger 10 by projecting to a position adjacent the firearm frame. Thus, when the trigger 10 starts to move about it's pivot point, the screw 15 immediately impacts the firearm frame thereby preventing any further movement of the trigger 10. In order to use the firearm after the screw 15 is in the safe position, the use merely retreats the screw 15 back into the aperture 5 using the special key 50.

In another embodiment, the threaded aperture 5 is located in the trigger guard 30 at a position just below or adjacent a lower part of the trigger 10. In this location, when the screw 15 is advanced to the safe position, a distal end 35, opposite the head 20, is position either immediately adjacent a part of the trigger 5 or actually contacts a part of the trigger 5. Thus, the screw 15, in this position, prevents accidental movement of the trigger. In this embodiment, while it is preferable that the screw 15 be no longer than the thickness of the trigger guard 30, it may be longer and still function. If the screw 15 were longer than the thickness of the trigger guard 30, in the use position, the screw 15 would project partially from the trigger guard 30.

One method of incorporating the present invention into an existing firearm is to drill a blank aperture and tap the aperture, thereby creating the screw threads. The screw 15 may then be inserted into the threaded aperture 5. Another method is to drill a blank aperture and press fitting, or securely inserting by other means such as screwing, a hollow blank or insert 40. The interior of the hollow blank 40 may be either pre-tapped or may be tapped after insertion into the blank aperture. Then, the screw 15 is inserted into the threaded aperture 5.

The preferred embodiment of the invention is described above in the Drawings and Description of Preferred Embodiments. While these descriptions directly describe the above embodiments, it is understood that those skilled in the art may conceive modifications and/or variations to the specific embodiments shown and described herein. Any such modifications or variations that fall within the purview of this description are intended to be included therein as well. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to the applicant at the time of filing the application has been presented and is intended for the purposes of illustration and description. It is not intended to be exhaustive or to limit the invention to the precise form disclosed, and many modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated.

What is claimed is:

1. A firearm safety device comprising a firearm with an exposed trigger, the trigger further comprising a threaded aperture located adjacent a portion of the firearm's frame and having a complementarily threaded screw contained therein, the screw being no longer than the thickness of the trigger.

2. The firearm safety device of claim 1 wherein the screw further includes a keyed head.

3. The firearm safety device of claim 2 wherein the keyed head is a pentagonal indentation with an outwardly projecting, generally centered, guide pin.

* * * * *